United States Patent [19]

Mulvihill

[11] 4,292,783

[45] Oct. 6, 1981

[54] INSULATED BUILDING STRUCTURE AND METHOD FOR MAKING SAME

[76] Inventor: Dan R. Mulvihill, 603 W. 3rd St., Coffeyville, Kans. 67337

[21] Appl. No.: 40,546

[22] Filed: May 21, 1979

[51] Int. Cl.[3] ..... E04B 1/00

[52] U.S. Cl. ..... 52/741; 52/91; 52/309.12; 52/405

[58] Field of Search ..... 52/91, 309.12, 404, 52/405, 443, 577, 600, 380, 381, 309.17, 741, 743, 251

[56] References Cited

U.S. PATENT DOCUMENTS

| | | | |
|---|---|---|---|
| 2,262,899 | 11/1941 | Mechlin | 52/405 X |
| 2,589,021 | 3/1952 | O'Neal | 52/380 |
| 3,108,406 | 10/1963 | Ellis | 52/381 X |
| 3,559,355 | 2/1971 | Day, Jr. | 52/275 X |
| 3,982,368 | 9/1976 | Perrin | 52/405 X |
| 4,125,981 | 11/1978 | MacLeod et al. | 52/381 X |

*Primary Examiner*—Carl D. Friedman
*Attorney, Agent, or Firm*—LaValle D. Ptak

[57] ABSTRACT

An insulated building is constructed by placing portable temporary vertical wall supports on a concrete floor slab for the building, hanging styrofoam insulating slabs on steel pins protruding from the supports, leaving beam openings between the styrofoam and the floor slab, and at the top between the styrofoam and the ceiling line for the building. Structurally rigid steel wire mesh is placed over the exterior side of the styrofoam slabs for the walls and is tied through the beam openings to anchors into the concrete floor slab at the bottom and into the other beam openings at the top. A roof is formed by laying structurally rigid steel mesh over the temporary wall supports and covering this roof mesh with slabs of insulation material. After doors and windows are set into the walls thus formed, and electrical and plumbing is roughed in, gunite concrete is sprayed onto the exterior surfaces of the walls and onto the underside of the roof. This embeds the steel mesh in a gunite layer which is simultaneously bonded to the insulating slabs by the impact of the gunite to form a structurally rigid building. The temporary supports then are removed, and the interior surfaces of the walls and the upper side of the roof are finished with a gunite layer to form the completed building structure.

4 Claims, 13 Drawing Figures

INSULATED BUILDING STRUCTURE AND METHOD FOR MAKING SAME

BACKGROUND OF THE INVENTION

In most parts of the world, construction of new buildings, both commercial buildings and homes, has been continuing at a rapid pace for a number of years. In many parts of the world, the construction pace outstrips the available skilled labor supply. For the most part, building construction techniques follow patterns which have been in existence for many years. Construction is fairly labor intensive, particularly in home building. As a consequence, if skilled labor is in short supply or is not readily available, construction of homes and the like falls below the demand; and often the quality of the finished construction is not as good as it should be.

In the United States, and in many other parts of the world, two general types of home construction are employed. These are masonry construction, using concrete blocks or bricks and frame construction in which a wooden frame for the house first is erected. This frame then is covered with suitable materials to form the exterior and interior walls, ceilings and roofs. Both of these types of construction require many hours of skilled labor.

In an effort to cut the costs of home building, some moderately sized homes have been "prefabricated", using assembly line techniques with only final assembly of prefinished wall panels, etc. being required on the construction site itself. Such techniques, however, have not reached wide-spread acceptance and there still exists a transportation problem in shipping prefinished panels or subassemblies to the construction site.

Ideally, it is desirable to provide a construction technique which permits shipment of bulk materials to the construction site, itself, but where the construction of the home or building may be effected rapidly, with readily available materials, by a minimum number of skilled workmen. This is particularly desirable in locations where large amounts of housing must be provided in a relatively short period of time to accommodate large influxes of people in fast growing areas. In such areas, conventional home building techniques generally require too much time, even if the necessary labor is available.

SUMMARY OF THE INVENTION

Accordingly it is an object of this invention to provide an improved method of building construction.

It is another object of this invention to provide an improved building construction.

It is an additional object of this invention to provide a method of building construction requiring a minimal amount of skilled labor.

It is a further object of this invention to provide a building construction for rapidly completing finished buildings.

It is yet another object of this invention to provide an improved insulated building construction.

It is still another object of this invention to provide an improved, strong, lightweight building construction utilizing preformed insulation slabs and gunite concrete as the primary construction materials.

In accordance with the preferred embodiment of this invention, a building construction for placement on a foundation comprises making the walls of an inner core of preformed insulating material. Gunite concrete then is sprayed onto the insulating material to provide structural rigidity and the finished wall surface. In more specific embodiments of the invention, a structurally rigid wire mesh is placed over at least one side of the insulating inner core and the wire mesh is embedded in the gunite concrete layer. The roof and ceiling are finished in a similar manner to the walls to form a strong insulated lightweight building requiring a minimum of labor to construct.

DETAILED DESCRIPTION

Reference now should be made to the drawings in which the same reference numbers are used throughout the different figures to designate the same or similar components.

Figure 1:
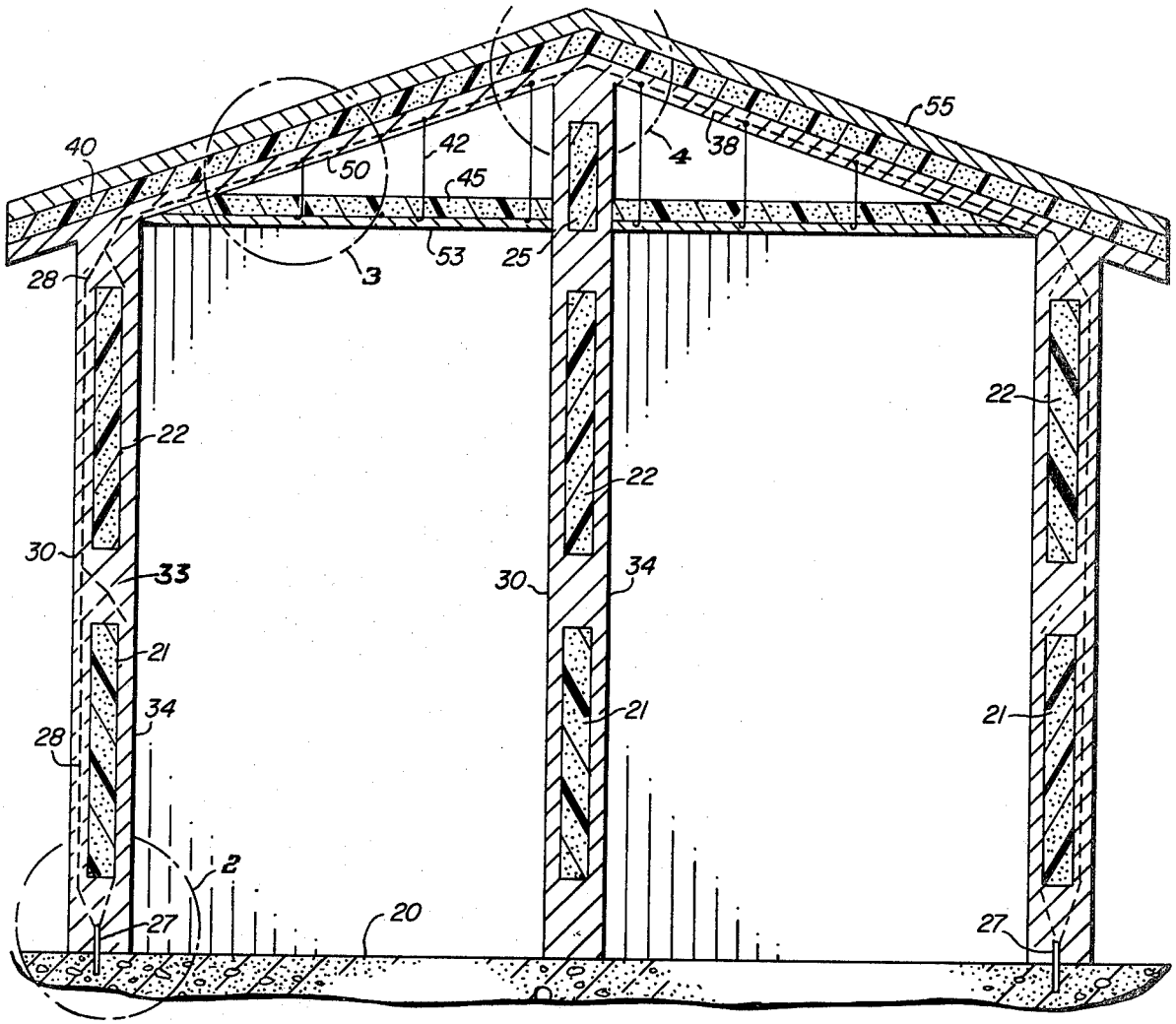
FIG. 1 is a cross-sectional view of a typical building constructed in accordance with a preferred embodiment of this invention.

Reference first should be made to FIG. 1, which is a cross-sectional view of a building constructed in accordance with a preferred embodiment of this invention. Construction of a building using the method and construction features of this invention is accomplished by first pouring a concrete floor slab 20 in a conventional manner to form the floor and foundation of the house or building to be constructed. All of the plumbing and electrical wiring, etc. are put into place prior to the pouring of the slab 20 which then is allowed to cure. By using the techniques of the building construction described herein, it is not necessary to provide any additional thickening or foundations at the wall bearing points on the slab for a single story structure. Such a structure can be supported on a four inch thick, 300 PSI slab of concrete which is uniform throughout. The dead load of the building constructed in accordance with the structure shown in the drawings is sufficiently light that this uniform thickness slab can be used as the combination floor and foundation member for the structure.

In FIG. 1, cross sections of three bearing walls (two exterior walls and one central interior wall) are shown, along with the cross-sectional structure of the roof and ceiling of the building. All of the walls include an inner core of preformed insulating material in the form of slabs of block insulation such as polyurethane or styrofoam. As shown in FIG. 1, two rows of spaced-apart insulation slabs 21 and 22 are used in each of the walls to form these inner cores. For the central wall, which is taller because a pitched roof is used in the building, a third slab 25, also is employed.

Each of the lowermost inner insulation slabs 21 is spaced from the concrete floor slab 20 or foundation by approximately six inches. In this space, at least on the outer walls, reinforcing bars 27 are embedded in the concrete slab 20 at the time it is poured. These bars 27 stick up into the space, as shown most clearly in FIG. 2.

To provide structural rigidity for the exterior bearing walls, 4×4×4 steel wire mesh 28 (four inch square using approximately one-fourth inch wire stock) is placed over the insulation slabs 21 and 22. This mesh 28 is extended into and bent up in a V-shaped configuration within the space below the slab 21 and is tied to the reinforcing bars 27 by suitable means, such as lacing it to the bars 27 with No. 9 wire or the like. The mesh 28 also is bent to extend into a space between the slabs 21 and 22 and into the space above the slab 22. The walls then are completed by spraying a gunite concrete layer 30 on the exterior side of the wall. This layer extends into the space between the slabs 21 and 22, as well as into the spaces above the slab 22 and below the slab 21 to form an exterior wall covering encasing the reinforcing mesh 28, as well as to form an equalizing beam at the top of the wall above the slab 22, tie beam 33 between the slabs 21 and 22 and a support beam between the bottoms of the slabs 21 and the floor slab 20. Similarly a gunite concrete layer 34 is sprayed on the inner surface of the exterior walls to complete the interior finish.

For the inside wall shown in the middle of FIG. 1, a similar construction is employed; but the reinforcing wire mesh is not used. The gunite concrete layers 30 and 34 are on opposite sides of the slabs 21 and 22 form the completed wall. An equalizing beam at the top, tie beam at the center, and support beam at the bottom of the wall are formed similarly to the construction of the exterior walls but without any reinforcing wire mesh in them.

The roof is defined by 4×4×4 steel mesh 38 laid over the supports used to form the exterior and interior bearing walls shown in FIG. 1. The steel mesh 38 as well as the steel mesh 28 used on the exterior bearing walls is available in flat sheets, generally eight feet wide by twelve to twenty feet in length. These sheets have substantial structural rigidity, so that the roof line is defined simply by the sheets of steel mesh 38 which are laid in place. Over these sheets, a two inch layer of slab or block insulation 40, preferably styrofoam, is set in place. If a pitched roof such as shown in FIG. 1 is used, the interior ceiling is supported by hanging No. 9 wire hooks 42 from the mesh 38 on approximately three foot centers to a position defining the ceiling line. Insulating block slabs 45 then are hung from the hooks 42 to define the ceiling line.

Figure 2:
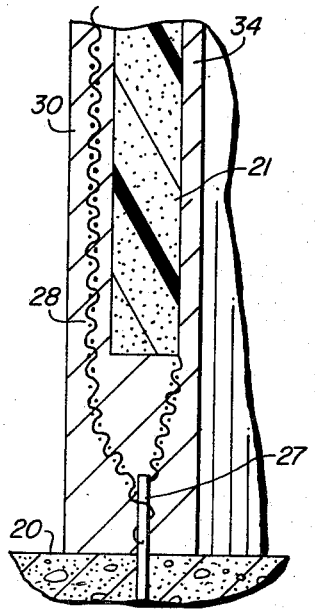
FIGS. 2, 3 and 4 are enlarged detailed views of portions of the construction shown in FIG. 1.
Figure 3:
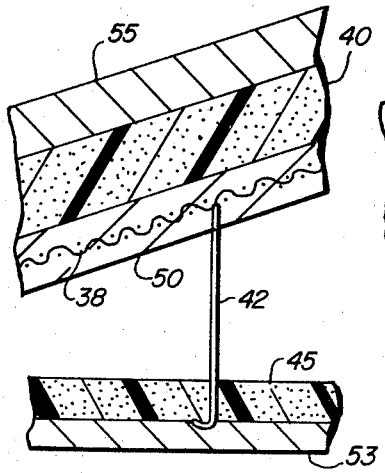
Figure 4:
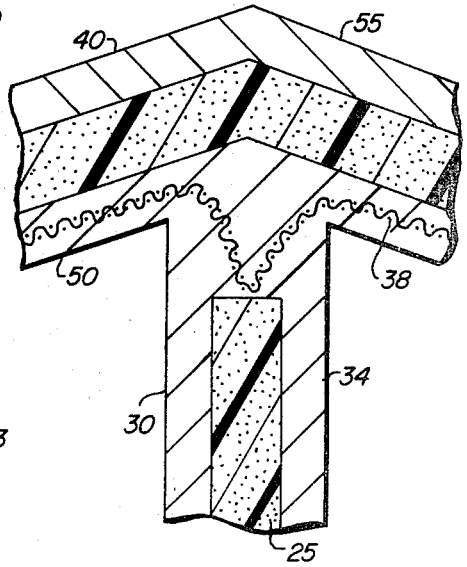

In the construction of the building, the mesh 38 is laced to the mesh 28 at the exterior walls by use of No. 9 wire to structurally tie the supporting wire mesh portions 28 and 38 together. With the slabs of insulating material 40 in place on the mesh 38, but prior to the placement of the insulating slabs 45 to define the ceiling, an interior layer of gunite concrete 50 is sprayed onto the underside of the roof to encase the roofing mesh 38. After this has been completed, the slabs 45 are put in place, and a ceiling layer of gunite concrete 53 is sprayed onto the underside of the ceiling insulating slabs 45 to form the finished interior surface of the ceiling. The completion of the building construction is effected by spraying a gunite concrete layer 55 on the upper side of the slabs 40. The details of the construction at various portions of the structure shown in FIG. 1 are illustrated in FIGS. 2, 3 and 4.

With the foregoing in mind, an understanding of the manner in which the structure described in FIGS. 1 through 4 is attained with a minimum amount of labor in a minimum amount of time follows in conjunction with reference to FIGS. 5 through 9. It is believed that the description of the method by which the building is constructed will most clearly show the advantages, both in time and labor saving as well as to arrive at a well-constructed, easily erected final product.

Figure 6:
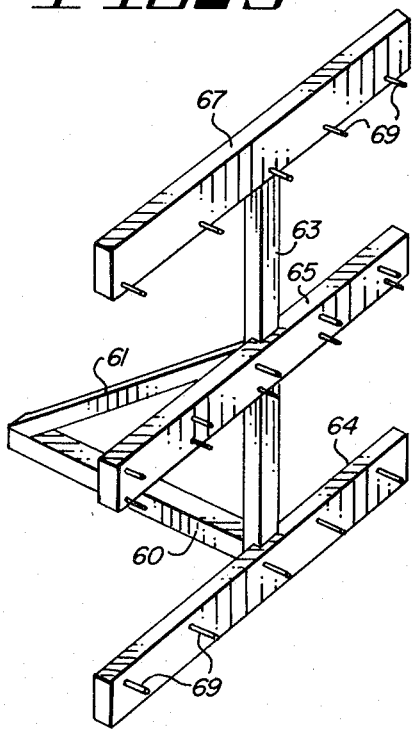
FIG. 6 is a perspective view of a temporary movable support used in the construction of the building shown in FIGS. 1 and 5.

Once the concrete floor slab 20 (FIG. 1) has been laid in accordance with the building plan, portable supports, formed in accordance with the predesigned size and shape of the exterior walls (including spaces and cutouts for windows, doors, etc.) are aligned to where the exterior walls will be set. One such portable support is shown in FIG. 6. The support includes a lower 4×4 base member 60 and an upright vertical 4×4 support member 63 to which a 4×4 angle brace 61 is attached. Three sets of running boards 64, 65 and 67 extend horizontally, as shown in FIG. 6, for the bottom support beam, middle tie beam and top equalizing beam, respectively, of the wall section with which the support member is used. As is apparent from reference to FIGS. 6 and 7, these running boards accommodate the particular configurations of these beams. For example, the lower running board 64 is placed on the floor slab 20 to define the shape of the lower support beam extending along the bottom of the wall. The running board 64 provides an enclosed space for the center tie beam in the wall. Similarly, the upper running board 67 has its upper edge cut to accommodate the pitch of the roof (shown in dotted lines in FIG. 7). If there is no pitch to the roof, the upper edge of the upper running board 67 extends to the ceiling height. Adjustment in the height of this portion of the support is made to accommodate the particular roof of the structure with which the support member shown in FIG. 6 is used.

Figure 7:
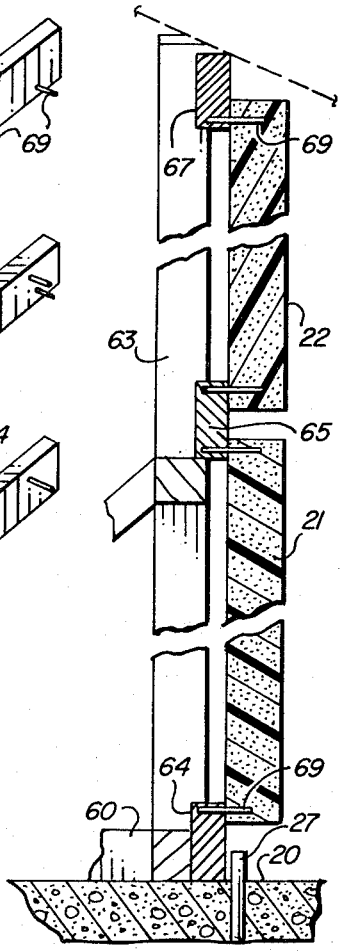
FIG. 7 shows details of the support of FIG. 6 as used in one step of the construction of the building.

Once the various support members of the type shown in FIG. 6 are set in place, the insulating blocks 21 and 22 made of elongated slabs of styrofoam, polyurethane or the like are set in place by impaling them on spaced steel pins 69 which extend from the upper edge of the lower running board 64, both the upper and lower edges of the center running board 65 and from the lower edge of the upper running board 67. In FIG. 7, the blocks 21 are shown impaled on the pins 69. Both blocks are pressed onto the pins 69 until they rest snugly against the running boards 64, 65 and 67. As can be seen in FIG. 7, the spaces between the insulating panels 21 and 22 and between each of these panels and the floor and roof respectively of the building structure define the various horizontal beams at the bottom, middle and top of the wall, respectively as described above. After the insulating slabs 21 and 22 are set in place, the exterior side of the exterior walls is covered with the sheets of 4×4×4 steel wire mesh 28 tied through the horizontal beam openings to the supports top, center and bottom. This wire mesh 28 and the manner in which it extends into each of these beam openings is shown most clearly in FIGS. 1 and 2.

Figure 5:
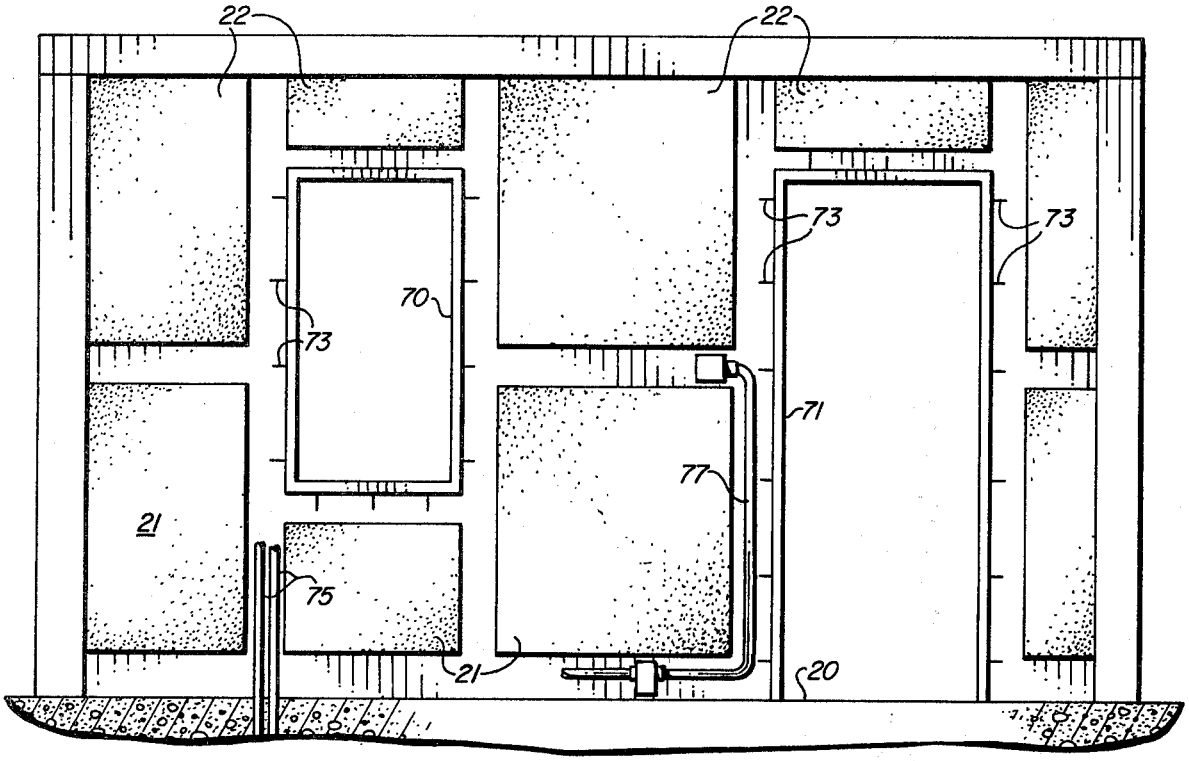
FIG. 5 is a side view of a portion of the building shown in FIG. 1, further illustrating details of the construction.

At each corner of the building, and vertically alongside all door and window openings, such as the window opening 70 and the door opening 71 in the wall shown in FIG. 5, vertical beams also are formed. Wire mesh 80 is inserted into these vertical openings, which similarly have vertical running boards backing them up attached to removable, portable supports of the type shown in FIG. 6 to define the vertical supports in the wall. The window frames for the window 70 and the door frames for the doors 71 are installed with nails or other suitable fastener extensions 73 passing through them into the spaces defined for the vertical and horizontal beams surrounding the window and door openings. Temporary support for the door frames and window frames is provided by the support members of the type shown in FIG. 6 in any suitable manner. The mesh 28, is cut out to fit the door and window frames and extend into the spaces between the insulation slabs 21 and 22 and the frames to form the final structural support surrounding the frames. The faces of the window frames and door frames are masked with suitable masking material to avoid direct contact with gunite concrete which is to be applied later.

Figure 8:
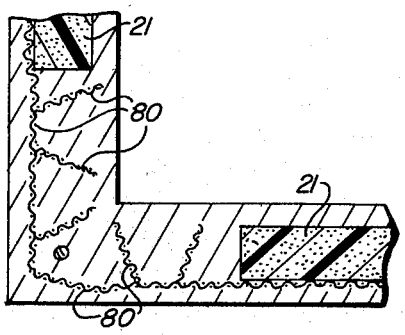
FIG. 8 is a cross-sectional view illustrating details of the construction of a corner of the building shown in FIG. 1.
Figure 9:
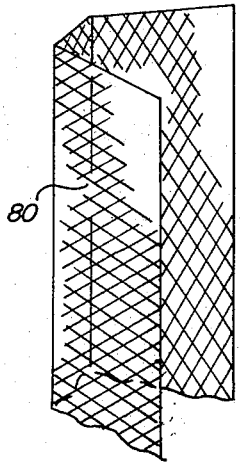
FIG. 9 is a perspective view of the reinforcing material used in the corner construction of the building.

Details of the construction of the corners of the building are shown in FIGS. 8 and 9. Three sets of U-shaped 4×4×4 mesh columns 80 are set in place, as shown, prior to the application of gunite concrete to embed them in the wall as shown in FIG. 8.

At this time, the electrical and plumbing connections are roughed in. Ideally the plumbing connections, such as indicated by the pipe 75 shown in FIG. 5, are made of PVC schedule 40 plastic or other conventional materials. The electrical wiring is placed in conduits 77 (FIG. 5) and both the plumbing and electrical conduits may be placed in the vertical and horizontal beam openings or portions of the styrofoam insulating slabs 21 and 22 may be cut out to accommodate the plumbing and the electrical conduits. Where the conduits 77 or plumbing 75 are not capable of self support, temporary ties of the conduit or plumbing to the movable supports (FIG. 6) may be made by any suitable means, such as with lightweight wire, or the like.

After all of the support or bearing walls have been completed to the point described above, the roof is constructed by laying a layer of 4×4×4 steel wire mesh across the top of the portable supports defining the bearing walls for the structure. In the building shown in FIG. 1, the roof has a pitch; so that the interior or center bearing wall is taller than the exterior walls. This defines the pitch of the roof. If the roof is to be flat, the interior temporary wall supports are the same height as the exterior wall supports.

The sheets of steel wire mesh 38 used to define the roof have sufficient structural rigidity that relatively wide spans may be crossed (of the order of 12 feet or more) without any additional internal temporary supports. The roof mesh 38 then is tied to or laced to the wall mesh 28 with No. 9 wire or other suitable fasteners to form an integral structure. If the roof is not flat, the hanger wires 42 (FIGS. 1 and 3) are huung on three foot centers to a position extending below the ceiling line; so that these hanger wires 42 subsequently may be bent into a hook shape to support blocks of performed ceiling insulation slabs 45. Of course, if a flat roof is used in the building, the hanger wires 42 are not necessary since the underside of the roof also then doubles in function as the ceiling of the rooms within the building.

After the roofing mesh 38 is in place, a single layer of two inch thick block insulation slabs 40 made of styrofoam, polyurethane, or other suitable material is laid on top of the roof mesh 38.

Although the door and window openings have been described above as being placed into or formed into the bearing walls prior to the installation of the roofing mesh 38 and its covering insulation layer 40, the doors and windows also may be placed in the walls at this point in the construction. All that is necessary is that all of the preliminary placement of the insulation slabs and the structural steel wire mesh for the bearing walls and roof should be in place prior to the application of the sprayed on gunite concrete layers 30, 34, 50 and 55, described previously in conjunction with the structure shown in FIGS. 1, 2, 3, and 4.

Now the exterior surface of the outer walls is sprayed with gunite concrete 30 to the desired thickness, typically on the order of one inch. Spraying the gunite from the outside also creates the horizontal and vertical support beams indicated in the various spaces between the insulating blocks 21 and 22 shown in FIG. 5. The limits of these support beams on the interior side of the walls are defined by the running boards (horizontal and vertical) of the various portable supports used to place the insulating slabs 21 and 22 in position prior to the application of the exterior gunite layer 30.

After the exterior walls have been sprayed with gunite, the gunite application of the interior is commenced. First the interior surface of the roof is sprayed with the gunite layer 50 between the supports to the desired thickness (again, typically one inch). The exterior wall support members of the type shown in FIG. 6 then are removed. The bearing walls then are sprayed on their interior side (the one on the same side to which the supports were previously attached). The thickness of the layer 34 once again may be adjusted to whatever thickness is desired for the particular construction. Typically, for a home or one story office building, a thickness of one inch is generally sufficient. A finisher with inside and outside corner trowels and a rubber float should be standing by during the process of spraying the gunite on both the exterior and interior surfaces of the walls to complete the corners, rub out blemishes, and remove screeds for the gunite.

The completion of the exterior of the roof next is commenced. This is done by starting at the outside eaves and working across and up the roof to the center by spraying gunite over the top of the roof insulation slabs 40 to form the outer gunite roof layer 55 (FIGS. 1, 3 and 4). This layer typically has a thickness of one and one-half inches.

At this time, the gunite gunman returns to the interior of the building and finishes the underside of the roof and any other portions where the removal of the interior supports requires touching up.

Now that the bearing walls, both interior and exterior, are completed and the roof has been completed, the ceiling, in the case of a pitched roof structure, is next put in place. Ceiling insulation blocks or slabs 45 are hung on the wires 42 as shown most clearly in FIG. 3 to suspend the ceiling from the completed roof. As is apparent from an examination of FIG. 1, no gunite concrete is applied to the upper side of the ceiling in the attic space.

Figure 10:
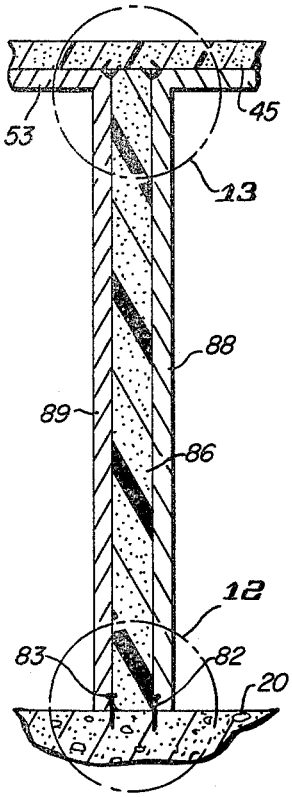
FIGS. 10, 11, 12 and 13 show details of the construction of non-bearing walls used in the building.
Figure 11:
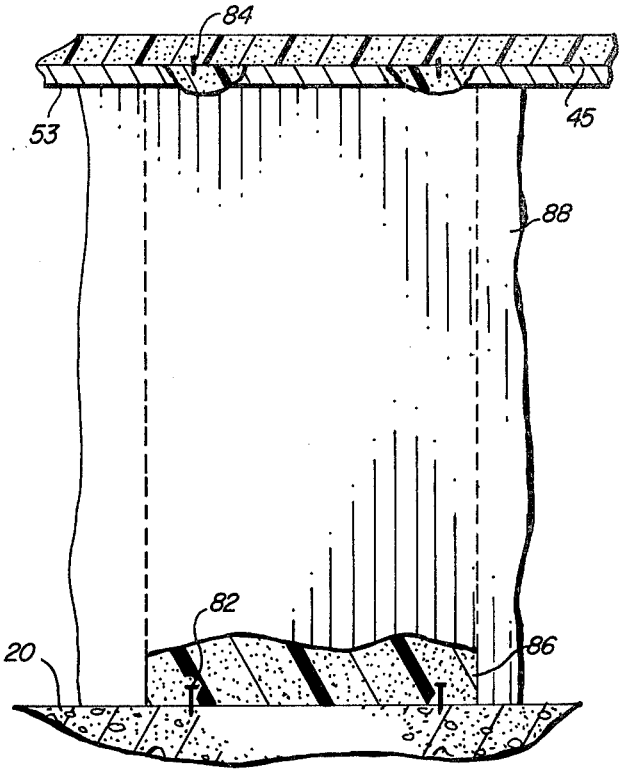
Figure 12:
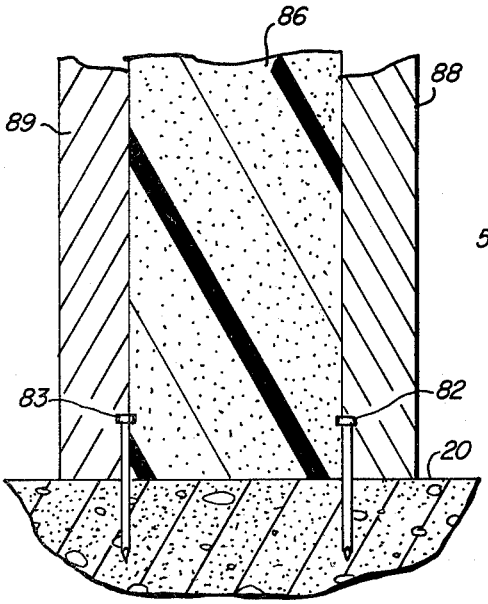
Figure 13:
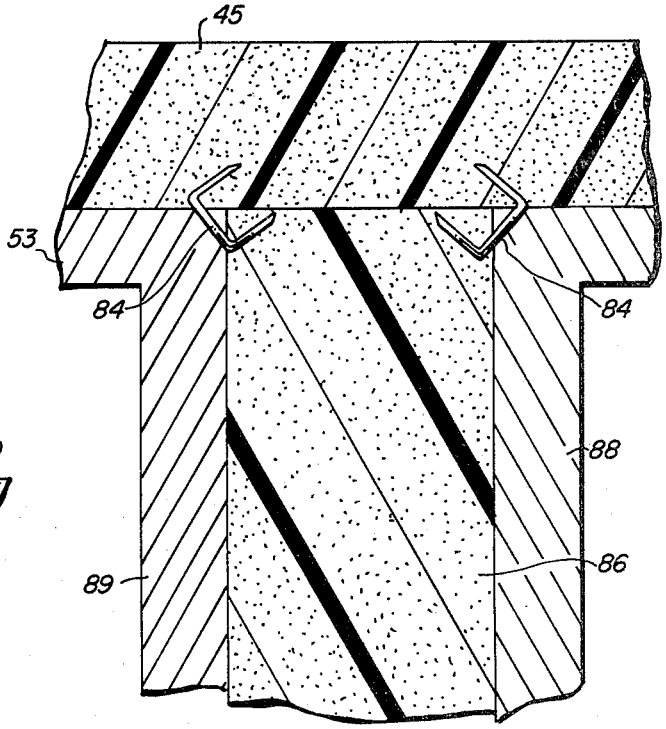

At this time the non-load bearing interior walls are set in place. To do this, two parallel rows of concrete nails 82 and 83 are driven into the floor slab 20, two inches apart at approximately 40 inch intervals on the non-load bearing wall partition lines (FIGS. 10, 11 and 12). Styrofoam or polyurethane insulating foam slab panels 86 then are set vertically between the parallel rows of nails 82 and 83 and are wedged under the ceiling insulating board panels 45, as shown most clearly in FIG. 10.

Staples 84 are used at the ceiling line to position the styrofoam slabs 86 in place with respect to the ceiling 45. The staples 84 do not serve to provide any structural rigidity but simply hold all of the panels 86 in place until completion of the interior of the building.

Next, door frames are installed by cutting the styrofoam panels 86 to suitable sizes to accommodate the frames. The interior door frames then are clipped by any suitable means to the panels 86 to hold them in place.

After all of the interior walls are in place and all of the door frames have been set in place and have been covered with suitable masking material, the ceiling and non-load bearing walls are sprayed with the desired monolithic thickness (typically one inch) of gunite concrete. This completes the ceiling with a gunite concrete layer 53 and completes the interior walls with gunite concrete layers 88 and 89, respectively. The finisher uses trowels and a rubber float to provide the desired completed finish on the interior walls and ceiling and to blend the ceiling gunite layer with the upper edge of the previously completed bearing walls, as necessary.

Since the gunite particles is a typical application travel at a speed of approximately 500 foot per second, they compact much harder into the insulating panels 21, 22 and 86 than plaster applied by a trowel. As a consequence, it is not necessary to provide any mesh or other material on the interior surfaces of the bearing walls or on any surfaces of the non-bearing walls to insure a tight bond between the gunite and the insulating material. The size of the sand used in the gunite which is applied to the surfaces determines the surface finish. Obviously, if a fine grain sand is used, a very smooth finish results. Conversely, if coarse sand is used, a coarse surface is obtained. Often a coarse finish is applied to the exterior side of the building and a finer gunite material is used on the interior surfaces. The particular surface, however, is unimportant to the structure which results and is chosen from the standpoint of aesthetics to meet the desires of the owner of the building.

Gunite concrete readily is worked for a smooth trowel finish; and if a fine sand finish is desired, very little work with a rubber float is required. After all of the gunite has been applied and finished, the masking material covering the door and window frames is removed and the building construction is complete.

The discussion of the embodiment shown in the drawings has been made for a typical single story building, such as used for a residence or small office building. If the building is constructed in a area where heavy loading is expected, such as an area where a heavy snowfall may be expected to place a large amount of weight on the roof, the method of construction remains the same; but heavier wire mesh, such as $6\times6\times6$ or heavier should be used. In addition, reinforcing bar may be extended vertically into the corners as well as the wire mesh. Also, additional reinforcing bars may be placed in all of the vertical columns extending alongside windows, doors, etc. as shown in FIG. 5. Similarly, for two story structures, steel rods and wires may be necessary in addition to the mesh which has been shown in the various figures of the drawings described above. This also may be true for areas in which the wind loading requirements are high or for areas where earthquake shocks may be expected. Variations in the particular size of wire mesh and additional reinforcing bar or reinforcing rods which may be desirable for additional strength are all considerations which will occur to those skilled in the art as obvious modifications of the invention illustrated in conjunction with the particular embodiment described above. Various other modifications and changes also will occur to those skilled in the art without departing from the scope of the invention.

I claim:

1. A method for constructing a building comprising the steps of:

vertically orienting performed slabs of insulating material removable temporary supports aligned to place a wall in location on a foundation member;

covering the at least one side of said slabs with structurally rigid wire mesh;

spraying gunite concrete onto said at least one surface of said wall over said mesh to form a structurally rigid insulated wall; and removing said temporary supports.

2. The method according to claim 1 wherein said preformed slabs of insulating material are hung on said temporary supports with spaces between the lower edge of said slabs and the foundation member and between the upper edge of said slabs of insulating material and the ceiling of the building, wherein said temporary supports have running boards to back up such spaces, the method further including the steps of:

placing reinforcing members extending from the foundation member into the space below the lower edge of said insulating slab; and extending said wire mesh into the spaces above and below the preformed slabs prior to the step of applying gunite concrete at which step said gunite concrete fills the spaces to form a horizontal support beam at the bottom of the wall and a horizontal equalizing beam at the top of the wall.

3. The combination according to claim 2 further including the step of placing a layer of structurally rigid roofing mesh over the temporary wall supports to outline the roof of the building;

placing a layer of roof insulation blocks over the roofing mesh;

applying gunite to the underside of said roof to bond said gunite to the roof insulation slabs and to embed the roofing mesh therein prior to removal of said temporary supports;

applying gunite concrete to the interior of said wall after removal of said temporary supports to finish the interior surface thereof; and applying a finishing roof coat to the upper surface of the roof insulation slabs to complete the building construction.

4. The method according to claim 1 wherein the step of vertically orienting said slabs of insulating material comprises hanging said preformed slabs of insulating material on said temporary supports with spaces between said slabs; and wherein said temporary supports have running boards to back up such spaces.

* * * * *

UNITED STATES PATENT AND TRADEMARK OFFICE

CERTIFICATE OF CORRECTION

PATENT NO. : 4,292,783

DATED : October 06, 1981

INVENTOR(S) : Dan R. Mulvihill

It is certified that error appears in the above-identified patent and that said Letters Patent are hereby corrected as shown below:

Column 8, Claim 1, Line 15:

After "material" insert --on--.

Signed and Sealed this

*Eighth* Day of *December 1981*

[SEAL]

*Attest:*

GERALD J. MOSSINGHOFF

*Attesting Officer*

*Commissioner of Patents and Trademarks*